US009564279B2

(12) United States Patent
Naka et al.

(10) Patent No.: US 9,564,279 B2
(45) Date of Patent: Feb. 7, 2017

(54) ELECTROMAGNETIC SWITCH HAVING MAGNETIC YOKE WITH SLITS

(71) Applicants: FUJI ELECTRIC FA COMPONENTS & SYSTEMS CO., LTD., Chuo-ku, Tokyo (JP); FUJI ELECTRIC CO., LTD., Kawasaki-shi, Kanagawa (JP)

(72) Inventors: Yasuhiro Naka, Kounosu (JP); Kenji Suzuki, Kounosu (JP); Masayoshi Sakata, Yokohama (JP)

(73) Assignees: FUJI ELECTRIC FA COMPONENTS & SYSTEMS CO., LTD., Tokyo (JP); FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 47 days.

(21) Appl. No.: 14/677,188

(22) Filed: Apr. 2, 2015

(65) Prior Publication Data

US 2015/0213986 A1 Jul. 30, 2015

Related U.S. Application Data

(63) Continuation of application No. PCT/JP2013/005819, filed on Sep. 30, 2013.

(30) Foreign Application Priority Data

Nov. 9, 2012 (JP) ..... 2012-247684

(51) Int. Cl.
*H01H 50/64* (2006.01)
*H01H 50/42* (2006.01)
(Continued)

(52) U.S. Cl.
CPC ..... *H01H 50/648* (2013.01); *H01H 50/36* (2013.01); *H01H 50/42* (2013.01); *H01H 9/446* (2013.01);
(Continued)

(58) Field of Classification Search
CPC ..... H01H 50/42; H01H 50/648; H01H 50/36; H01H 2205/002
See application file for complete search history.

(56) References Cited

U.S. PATENT DOCUMENTS 5,883,557 A * 3/1999 Pawlak ..... H01H 51/2209 335/177
6,700,466 B1 * 3/2004 Yamamoto ..... H01H 9/302 218/156
(Continued)

FOREIGN PATENT DOCUMENTS

EP 2557582 A 2/2013
JP S61-57444 U 4/1986
(Continued)

OTHER PUBLICATIONS

PCT, "International Search Report for International Application No. PCT/JP2013/005819".

*Primary Examiner* — Bernard Rojas
(74) *Attorney, Agent, or Firm* — Manabu Kanesaka

(57) ABSTRACT

An electromagnetic switch includes a pair of fixed contacts disposed and fixed in a contact housing case with a predetermined distance therebetween; a movable contact disposed in the contact housing case so as to contact and separate from the pair of fixed contacts; and an electromagnet unit which brings the movable contact into and out of contact with the pair of fixed contacts. The electromagnet unit has a magnetic yoke enclosing an exciting coil, a movable plunger having a contact pole surface facing the contact pole surface of the magnetic yoke, and a linking shaft which links the
(Continued)

movable plunger and the movable contact, and magnetic paths through which a holding force is generated by external magnetic fluxes generated by a flowing current when the movable contact contacts the pair of fixed contacts, are formed on the contact pole surface of the magnetic yoke.

8 Claims, 15 Drawing Sheets

(51) Int. Cl.
*H01H 50/36* (2006.01)
*H01H 9/44* (2006.01)
*H01H 50/02* (2006.01)

(52) U.S. Cl.
CPC .. *H01H 2050/025* (2013.01); *H01H 2205/002* (2013.01)

(56) References Cited

U.S. PATENT DOCUMENTS

| | | | | |
|---|---|---|---|---|
| 8,937,518 | B2 * | 1/2015 | Suzuki | H01H 9/443 335/126 |
| 2013/0127571 | A1 * | 5/2013 | Takaya | H01H 9/443 335/201 |

FOREIGN PATENT DOCUMENTS

| | | | | |
|---|---|---|---|---|
| JP | H02-010621 | A | 1/1990 | |
| JP | 2012-038684 | A | 2/2012 | |
| JP | 2012-054047 | A | 3/2012 | |
| JP | WO 2012029218 | A1 * | 3/2012 | H01H 9/443 |

* cited by examiner

ELECTROMAGNETIC SWITCH HAVING MAGNETIC YOKE WITH SLITS

RELATED APPLICATIONS

The present application is a continuation Application of International Application No. PCT/JP2013/005819 filed Sep. 30, 2013, which claims a priority from Japanese Application No. 2012-247684 filed Nov. 9, 2012, the disclosure of which is hereby incorporated by reference herein in its entirety.

TECHNICAL FIELD

The present invention relates to an electromagnetic switch having a pair of fixed contacts disposed with a predetermined distance from each other and a movable contact disposed so as to be able to come into and but of contact with the fixed contacts.

BACKGROUND ART

For an electromagnetic switch, such as an electromagnetic relay or an electromagnetic contactor, which carries out switching of a current path, various kinds of contact mechanism have heretofore been proposed wherein an arc generated at an open contact time when a movable contact is separated from fixed contacts is extinguished in order to switch the contact mechanism from a closed state, in which a current flows by contacting the fixed contacts and movable contact each other, to an open state by interrupting the current.

For example, an electromagnetic switch including a pair of fixed contacts, each having a fixed contact point, which are spaced with a predetermined distance from each other, a movable contact, having movable contact points at the left and right ends thereof, which is disposed so as to be able to come into and out of contact with the pair of fixed contacts, and an electromagnet device, which drives the movable contact, is proposed, as described in PTL 1.

The electromagnet device of the electromagnetic switch includes a U-section magnetic yoke having an upper opening, an upper magnetic yoke covering the upper opening of the magnetic yoke, a movable core which is moved up and down by an exciting coil, and a linking shaft which links the movable core and the movable contact through a through hole formed in the upper magnetic yoke.

CITATION LIST

Patent Literature

PTL 1: JP-A-2012-38684

SUMMARY OF INVENTION

Technical Problem

Meanwhile, in the heretofore known example described in the PTL 1, a current path is formed by bringing the movable contact into contact with the pair of fixed contacts. The electromagnet device which brings the movable contact to contact with or separate from the pair of fixed contacts is disposed on the lower side of the pair of fixed contacts and movable contact.

Because of this, there is an unsolved problem that in a condition in which the movable contact is brought into contact with the pair of fixed contacts to cause a comparatively high current of several hundred to several thousand amps to flow, magnetic fluxes generated by the flowing current may affect an attractive force acting on a contact pole surface between the upper magnetic yoke and movable core of the electromagnet device.

Therefore, the invention has been contrived on the heretofore described unsolved problem of the heretofore known example, and has a purpose to provide an electromagnetic switch wherein it is possible to prevent the effect of the magnetic fluxes generated by the flowing current on the attractive force and thus secure a stable operation.

Solution to Problem

In order to achieve the heretofore described purpose, in a first aspect of an electromagnetic switch according to the invention, the electromagnetic switch includes a pair of fixed contacts disposed and fixed in a contact housing case with a predetermined distance therebetween; a movable contact disposed in the contact housing case so as to contact with and separate from the pair of fixed contacts; and an electromagnet unit which brings the movable contact into and out of contact with the pair of fixed contacts. The electromagnet unit has a magnetic yoke enclosing an exciting coil, a movable plunger having a contact pole surface facing the contact pole surface of the magnetic yoke, and a linking shaft which links the movable plunger and the movable contact. Magnetic paths through which a holding force is generated by external magnetic fluxes generated by a flowing current when the movable contact contacts the pair of fixed contacts, are formed on the contact pole surface of the magnetic yoke.

Also, in a second aspect of the electromagnetic switch according to the invention, the electromagnetic switch includes a pair of fixed contacts disposed and fixed in a contact housing case with a predetermined distance therebetween; a movable contact disposed in the contact housing case so as to contact with and separate from the pair of fixed contacts; and an electromagnet device which brings the movable contact into and out of contact with the pair of fixed contacts. The electromagnet device has a magnetic yoke enclosing an exciting coil, a movable plunger, disposed so as to move through a through hole provided in the magnetic yoke, which has a contact pole surface facing the contact pole surface of the magnetic yoke, and a linking shaft which links the movable plunger and the movable contact. Magnetic paths through which a holding force is generated by external magnetic fluxes generated by a flowing current when the movable contact contacts the pair of fixed contacts, are formed in the contact pole surface of the magnetic yoke.

Also, in a third aspect of the electromagnetic switch according to the invention, the magnetic yoke includes a U-shaped magnetic yoke having an upper opening and surrounding the exciting coil, and an upper magnetic yoke which covers the upper opening of the U-shaped magnetic yoke and has a through hole passing vertically through the upper magnetic yoke; and the magnetic paths are formed on the contact pole surface of the upper magnetic yoke.

Also, in a fourth aspect of the electromagnetic switch according to the invention, the movable plunger has a flange portion facing the contact pole surface of the upper magnetic yoke from above, and the lower surface of the flange portion is formed as a contact pole surface.

Also, in a fifth aspect of the electromagnetic switch according to the invention, the magnetic paths are formed of slits extending toward an outside of the movable contact from the through hole of the magnetic yoke.

Also, in a sixth aspect of the electromagnetic switch according to the invention, the slits include two pairs of slit portions extending parallel to each other from the through hole and formed in positions which sandwich the through hole and face the movable contact.

Also, in a seventh aspect of the electromagnetic switch according to the invention, the slits include two sets of a plurality slit portions extending radially from the through hole and formed in positions which sandwich the through hole and face the movable contact.

Also, in an eighth aspect of the electromagnetic switch according to the invention, the slits open into the through hole.

Advantageous Effects of Invention

According to the invention, magnetic paths through which a holding force is generated by external magnetic fluxes generated by a flowing current when the movable contact comes into contact with the pair of fixed contacts, are formed on the contact pole surface of the magnetic yoke which holds the movable plunger by energization of the exciting coil. Because of this, it is possible to secure the force of holding the movable contact with the external magnetic fluxes, thereby reliably preventing the electromagnetic switch from taking on a release condition in which the movable contact comes out of contact with the pair of fixed contacts when a current flows, and thus secure a stable operation of the electromagnetic switch.

DESCRIPTION OF EMBODIMENTS

Figure 1:
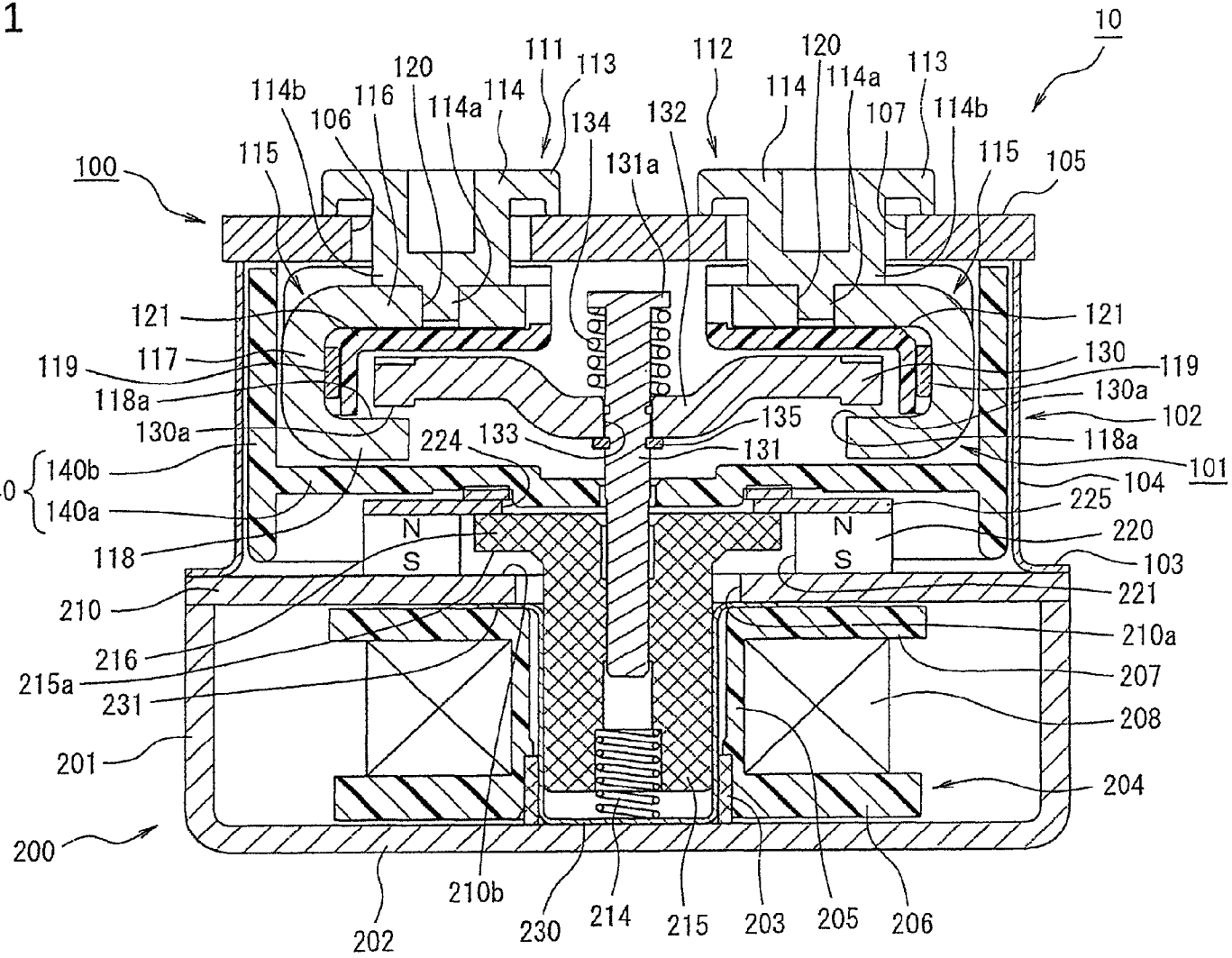
FIG. 1 is a sectional view showing a first embodiment of an electromagnetic switch according to the invention.

Hereafter, a description will be given, referring to the drawings, of an embodiment of the invention.

Figure 2:
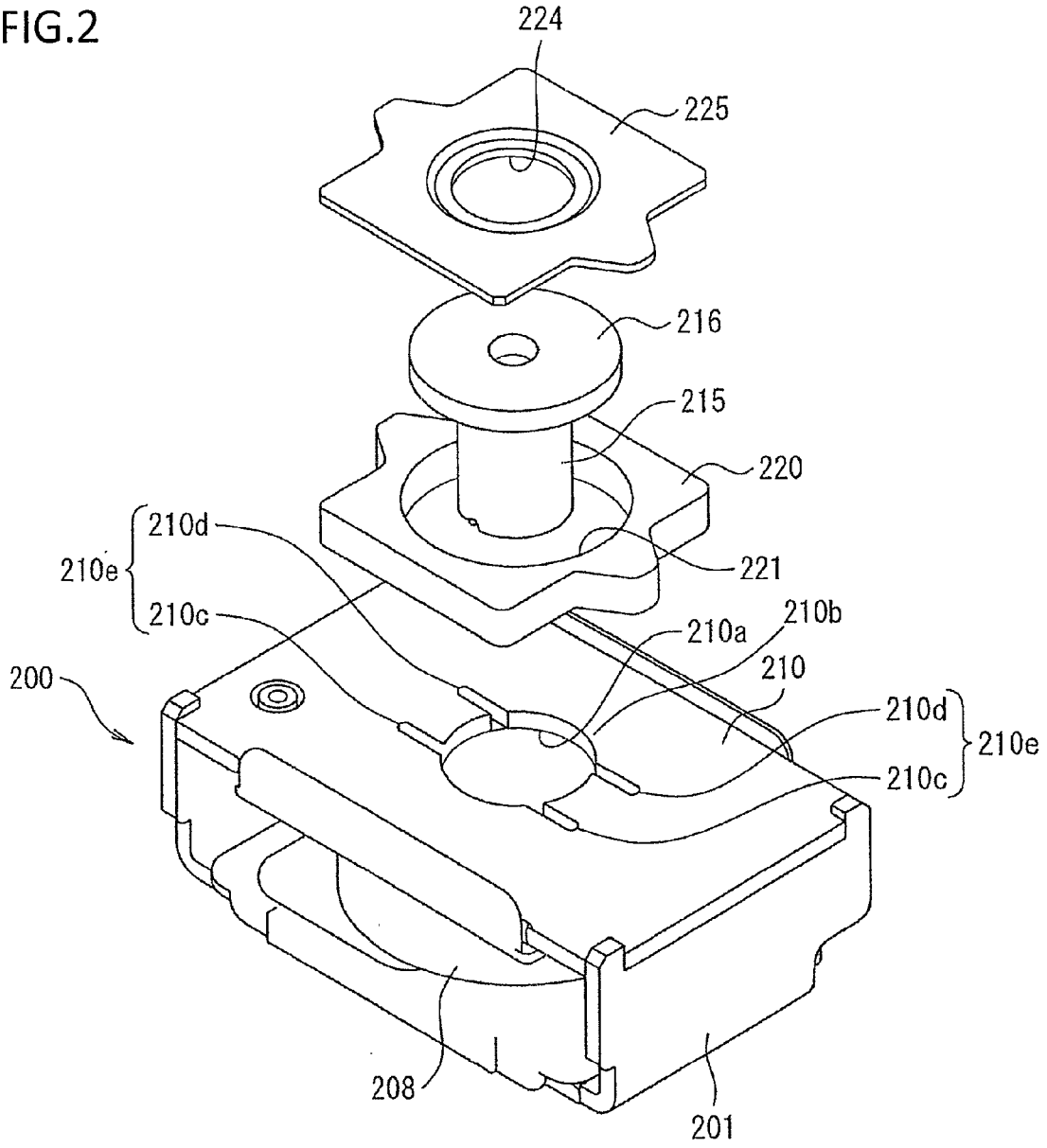
FIG. 2 is an exploded perspective view of an electromagnet device.

FIG. 1 is a sectional view showing a first embodiment when an electromagnetic switch according to the invention is applied to an electromagnetic contactor, and FIG. 2 is an exploded perspective view of an electromagnet unit.

Figure 10:
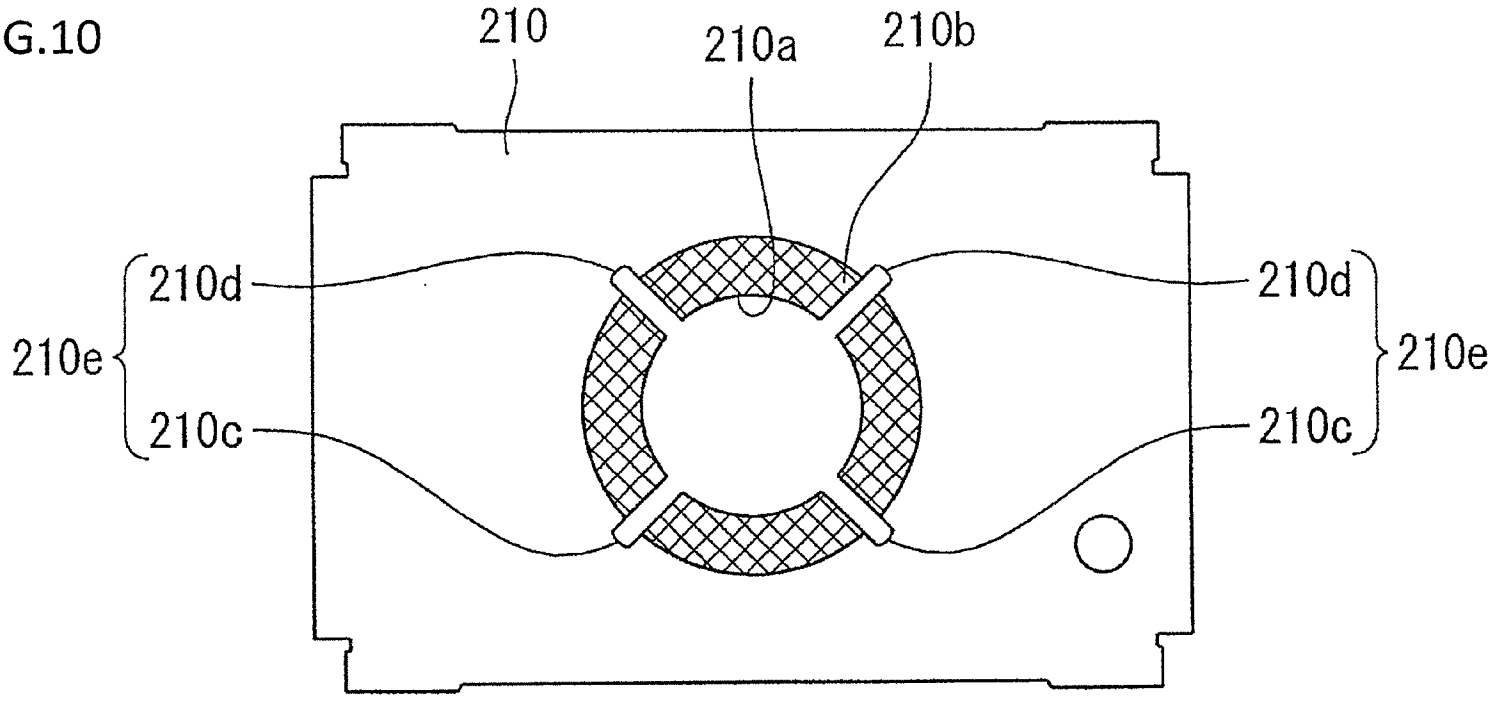
FIG. 10 is a plan view showing another example of the upper magnetic yoke of the invention.

In FIGS. 1 and 2, 10 is an electromagnetic contactor, and the electromagnetic contactor 10 includes a contact device 100 in which a contact mechanism is disposed and an electromagnet unit 200 which drives the contact device 100.

The contact device 100, as clearly shown in FIGS. 1 and 2, has a contact housing case 102, acting as an arc extinguishing chamber, which houses a contact mechanism 101. The contact housing case 102 includes a metal quadrangular cylindrical body 104, which has a metal flange portion 103 protruding outward in the lower end portion thereof, and a fixed contact support insulating substrate 105, forming a top plate, which has a flat plate-like ceramic insulating substrate which closes the top of the metal quadrangular cylindrical body 104.

The metal quadrangular cylindrical body 104 is fixed such that the flange portion 103 is seal-joined to an upper magnetic yoke 210 of the electromagnet unit 200, to be described hereafter.

Also, through holes 106 and 107 are formed in a central portion of the fixed contact support insulating substrate 105 to insert a pair of fixed contacts 111 and 112, to be described hereafter, with a predetermined distance therebetween. Positions on the upper surface side of the fixed contact support insulating substrate 105 around the through holes 106 and 107, and a position on the lower surface side thereof which contacts the metal quadrangular cylindrical body 104, are metalized.

The contact mechanism 101, as shown in FIG. 1, includes the pair of fixed contacts 111 and 112 inserted in the through holes 106 and 107 of the fixed contact support insulating substrate 105 of the contact housing case 102 to fix thereon. Each of the fixed contacts 111 and 112 includes a support conductor portion 114, having a flange portion 113 protruding outward at the upper end thereof, which is inserted into respective through holes 106 and 107 of the fixed contact support insulating substrate 105, and a C-shaped contact conductor portion 115, opening inward, which is linked to the support conductor portion 114 and disposed on the lower surface side of the fixed contact support insulating substrate 105.

The contact conductor portion 115 includes an upper plate portion 116, acting as a second linking plate portion, which extends outward along the lower surface of the fixed contact support insulating substrate 105, an intermediate plate portion 117, acting as a linking plate portion, which extends downward from the outer side end portion of the upper plate portion 116, and a lower plate portion 118, acting as a contact plate portion, which extends parallel to the upper plate portion 116 and inward, that is, in a direction facing each of the fixed contacts 111 and 112, from the lower end side of the intermediate plate portion 117. Because of this, the contact conductor portion 115 is formed in a C-shape wherein the upper plate portion 116 is added to an L-shaped portion formed of the intermediate plate portion 117 and lower plate portion 118.

Herein, the support conductor portion 114 and the contact conductor portion 115 are fixed by, for example, brazing in a state which a pin 114*a* formed to protrude from the lower end surface of the support conductor portion 114 is inserted in a through hole 120 formed in the upper plate portion 116 of the contact conductor portion 115. The fixation of the support conductor portion 114 and contact conductor portion 115 is carried out not only by brazing, but also by fitting the pin 114*a* on the through hole 120, or by forming an external thread in the pin 114*a* and an internal thread on the through hole 120 and bringing the external and internal threads into threaded engagement with each other.

Also, a magnetic material plate 119 of a C-shape in plan view is mounted so as to cover the inner side surface of the intermediate plate portion 117 of the contact conductor portion 115 of each fixed contact 111 and 112. By the magnetic material plate 119 disposed so as to cover the inner side surface of the intermediate plate portion 117 in this way, it is possible to shield a magnetic field generated by a current flowing through each intermediate plate portion 117.

Consequently, both the magnetic fields repel each other, and by this electromagnetic repulsive force causing an arc to move inward along a movable contact 130, it is possible to prevent the arc from being difficult to interrupt. The magnetic material plate 119 may be formed so as to cover the periphery of the intermediate plate portion 117, and only has to be able to shield the magnetic field generated by the current flowing through each intermediate plate portion 117.

Furthermore, an insulating cover 121, made of a synthetic resin material, which restrains arc commutation, is mounted on each of the contact conductor portions 115 of the fixed contacts 111 and 112.

By mounting the insulating cover 121 on each of the contact conductor portions 115 of the fixed contacts 111 and 112 in this way, only the inner side upper surface side of the lower plate portion 118 is exposed from the inner peripheral surface of the contact conductor portion 115, thus forming a contact portion.

Further, the movable contact 130 is disposed such that two end portions thereof are respectively positioned inside the contact conductor portions 115 of the fixed contacts 111 and 112. The movable contact 130 is supported on a linking shaft 131 fixed in a movable plunger 215 of the electromagnet unit 200, to be described hereafter. The movable contact 130, as shown in FIG. 1, includes a depressed portion 132 formed such that the vicinity of the linking shaft 131 in the central portion of the movable contact 130 protrudes downward, and a through hole 133 into which the linking shaft 131 is inserted, is formed in the depressed portion 132.

The linking shaft 131 has a flange portion 131*a* formed at the upper end thereof and protruding outward. The linking shaft 131 is inserted into a contact spring 134 from the lower end side, and next, inserted into the through hole 133 of the movable contact 130, the upper end of the contact spring 134 is brought into abutment with the flange portion 131*a*, and the movable contact 130 is positioned by, for example, a C-ring 135 so as to obtain a predetermined biasing force from the contact spring 134.

In a release condition, the movable contact 130 attains a state wherein flat movable contact portions 130*a* at either end of the movable contact 130 and flat fixed contact portions 118*a* of the lower plate portions 118 of the contact conductor portions 115 of the fixed contacts 111 and 112 are separated with a predetermined distance from each other. Also, the movable contact 130 is set such that in a turn-on position, both ends of the contact portions come into contact with the fixed contact portions 118*a* of the lower plate portions 118 of the contact conductor portions 115 of the fixed contacts 111 and 112 with a predetermined contact pressure of the contact spring 134.

Furthermore, an insulating cylindrical body 140 formed in a bottomed quadrangular cylindrical shape of a bottom plate portion 140*a* and a quadrangular cylindrical body 140*b* formed on the upper surface of the bottom plate portion 140*a*, is disposed on the inner peripheral surface of the metal quadrangular cylindrical body 104 of the contact housing case 102, as shown in FIG. 1. The insulating cylindrical body 140, being made of, for example, a synthetic resin, is formed such that the bottom plate portion 140*a* and the quadrangular cylindrical body 140*b* are integrally molded thereinto.

As shown in FIGS. 1 and 2, the electromagnet unit 200 has a magnetic yoke 201 of a flattened U-shape in the side view, and a round cylindrical auxiliary yoke 203 is fixed to the central portion of a bottom plate portion 202 of the magnetic yoke 201. A spool 204 is disposed on the outer side of the round cylindrical auxiliary yoke 203.

The spool 204 includes a central round cylindrical portion 205 into which the round cylindrical auxiliary yoke 203 is inserted, a lower flange portion 206 protruding radially outward from the lower end portion of the central round cylindrical portion 205, and an upper flange portion 207 protruding radially outward from slightly below the upper end of the central round cylindrical portion 205. Further, an exciting coil 208 is wound in a housing space defined by the central round cylindrical portion 205, lower flange portion 206, and upper flange portion 207.

Figure 3:
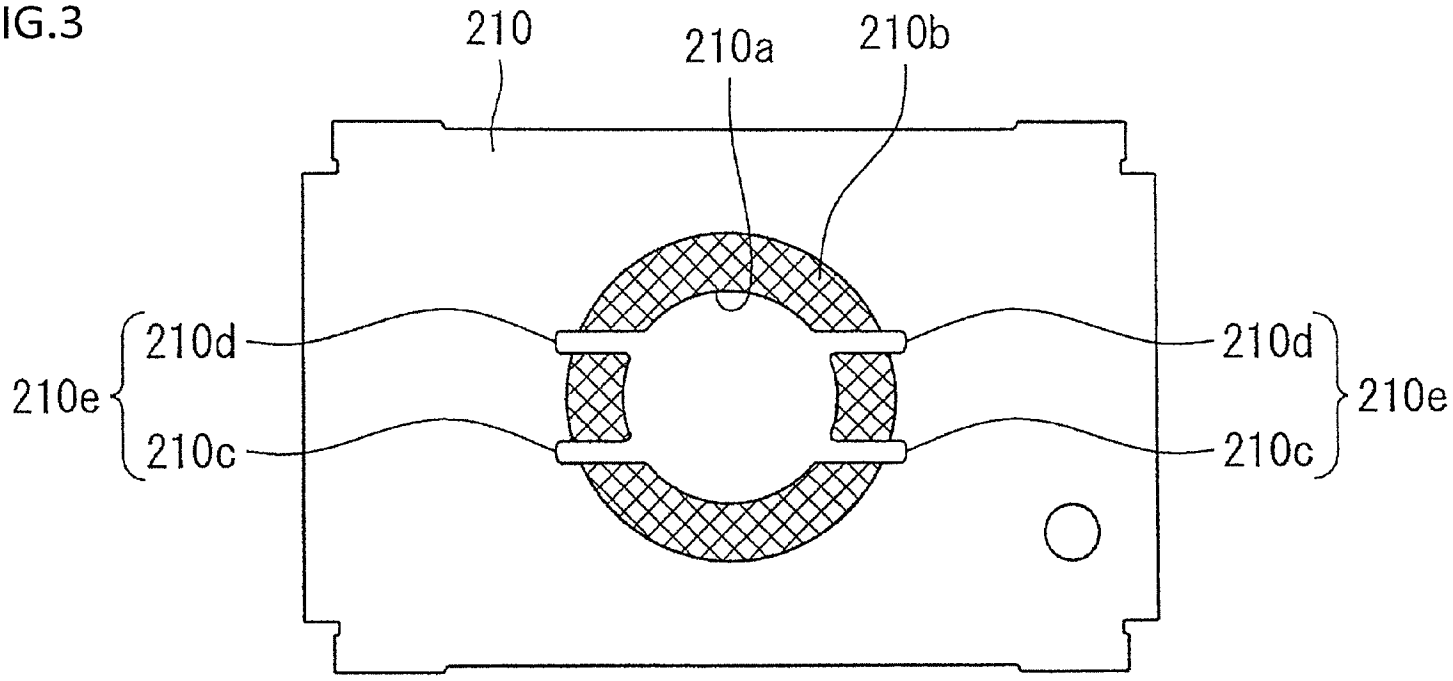
FIG. 3 is a plan view showing an upper magnetic yoke.

Further, the upper magnetic yoke 210 is fixed between the upper ends, which form the open end, of the magnetic yoke 201. As shown in FIG. 3, the upper magnetic yoke 210 has a through hole 210*a* opposite to the central round cylindrical portion 205 of the spool 204, formed in the central portion thereof, and the upper surface side of the upper magnetic yoke 210 around the through hole 210*a* is formed as a contact pole surface 210*b*. Also, slits 210*e* having mutually parallel slit portions 210*c* and 210*d* which open into the through hole 210*a* across the contact pole surface 210*b*, in respective left and right positions in the through hole 210*a* opposite to the movable contact 130, are formed. By providing the slits 210*c* and 210*d*, magnetic paths through which a holding force is generated by external magnetic fluxes generated by a flowing current when the movable contact 130 comes into contact with the pair of fixed contacts 111 and 112, is formed between the slit portions 210*c* and 210*d*.

Further, the movable plunger 215 having a return spring 214 disposed between the bottom portion thereof and the bottom plate portion 202 of the magnetic yoke 201, is disposed in the central round cylindrical portion 205 of the spool 204 so as to be able to slide up and down. A peripheral flange portion 216 protruding radially outward is formed in an upper end portion of the movable plunger 215 protruding upward from the upper magnetic yoke 210.

Also, a circularly formed permanent magnet 220 whose external shape is, for example, quadrangular and which has a round central opening 221, is fixed to the upper surface of the upper magnetic yoke 210 so as to surround the peripheral flange portion 216 of the movable plunger 215. The permanent magnet 220 is magnetized with the upper end side as, for example, the N pole, and the lower end side as the S pole, in the up-down direction, that is, the thickness direction.

Further, an auxiliary yoke 225, having the same external shape as the permanent magnet 220, which has a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 is brought into abutment with the lower surface of the auxiliary yoke 225.

The shape of the permanent magnet 220, not being limited to the heretofore described, can also be formed in an annular shape, and the external shape thereof can, in sum, be formed in any shape, such as a round shape or a polygonal shape, as long as the inner peripheral surface of the permanent magnet 220 is matched to the shape of the peripheral flange portion 216.

Also, the linking shaft 131 which supports the movable contact 130 is screwed in the upper end surface of the movable plunger 215.

Furthermore, the movable plunger 215 is covered with a cap 230, made of a non-magnetic material, which is formed in a bottomed cylindrical shape, and a flange portion 231 formed by extending radially outward from the open end of the cap 230 is seal-joined to the lower surface of the upper magnetic yoke 210. Thereby, a hermetic container is formed such that the contact housing case 102 and the cap 230 are caused to communicate with each other via the through hole 210*a* of the upper magnetic yoke 210.

Further, a gas, such as a hydrogen gas, a nitrogen gas, a mixed gas of hydrogen and nitrogen, air, or $SF_6$, is sealed in the hermetic container formed of the contact housing case 102 and cap 230.

Next, a description will be given of an operation of the heretofore described embodiment.

Now, it is assumed that the fixed contact 111 is connected to, for example, a power supply source which supplies a large current, while the fixed contact 112 is connected to a load.

It is assumed, in this state, that a release condition wherein the exciting coil 208 in the electromagnet unit 200 is in a non-excited state, and no exciting force to descend the movable plunger 215 is generated in the electromagnet unit 200, is attained.

In the release condition, the movable plunger 215 is biased by the return spring 214 in an upward direction away from the upper magnetic yoke 210. At the same time, an attractive force generated by the magnetic force of the permanent magnet 220 is caused to act on the auxiliary yoke 225, and the peripheral flange portion 216 of the movable plunger 215 is attracted to the auxiliary yoke 225. Because of this, the upper surface of the peripheral flange portion 216 of the movable plunger 215 is in abutment with the lower surface of the auxiliary yoke 225.

Because of this, the movable contact portions 130*a* of the movable contact 130 of the contact mechanism 101 linked to the movable plunger 215 via the linking shaft 131 are separated by a predetermined distance upward from the fixed contact portions 118*a* of the fixed contacts 111 and 112. Because of this, a current path between the fixed contacts 111 and 112 is in an interrupted state, and the contact mechanism 101 attains an open state.

In this way, in the release condition of the electromagnet unit 200, both the biasing force of the return spring 214 and the attractive force of the circular permanent magnet 220 act on the movable plunger 215. Because of this, it does not happen that the movable plunger 215 descends inadvertently due to external vibration, impact, or the like, and it is thus possible to reliably prevent a malfunction.

In order to supply power to the load in the open state, the exciting coil 208 of the electromagnet unit 200 is excited to generate an exciting force in the electromagnet unit 200, thus forming magnetic paths which pass from the movable plunger 215 through the peripheral flange portion 216, from a contact pole surface 215*a* of the movable plunger 215 through the contact pole surface 210*b* of the upper magnetic yoke 210, from the left and right end portions of the upper magnetic yoke 210 through the magnetic yoke 201, and through the auxiliary yoke 203 to the movable plunger 215.

Owing to the magnetic paths, the contact pole surface 215*a* of the movable plunger 215 is attracted by the contact pole surface 210*b* of the upper magnetic yoke 210 which faces the contact pole surface 215*a*, thus causing the movable plunger 215 to descend against the biasing force of the return spring 214 and the attractive force of the circular permanent magnet 220. The descent of the movable plunger 215 is stopped by the lower surface of the peripheral flange portion 216 coming into abutment with the upper surface of the upper magnetic yoke 210.

By descending the movable plunger 215 in this way, the movable contact 130 linked to the movable plunger 215 via the linking shaft 131 also descends, and the movable contact portions 130*a* of the movable contact 130 come into contact with the fixed contact portions 118*a* of the fixed contacts 111 and 112 with the contact pressure of the contact spring 134.

Because of this, a closed condition wherein the large current of the external power supply source is supplied to the load through a main circuit formed of the fixed contact 111, movable contact 130, and fixed contact 112, is attained.

Figure 4:
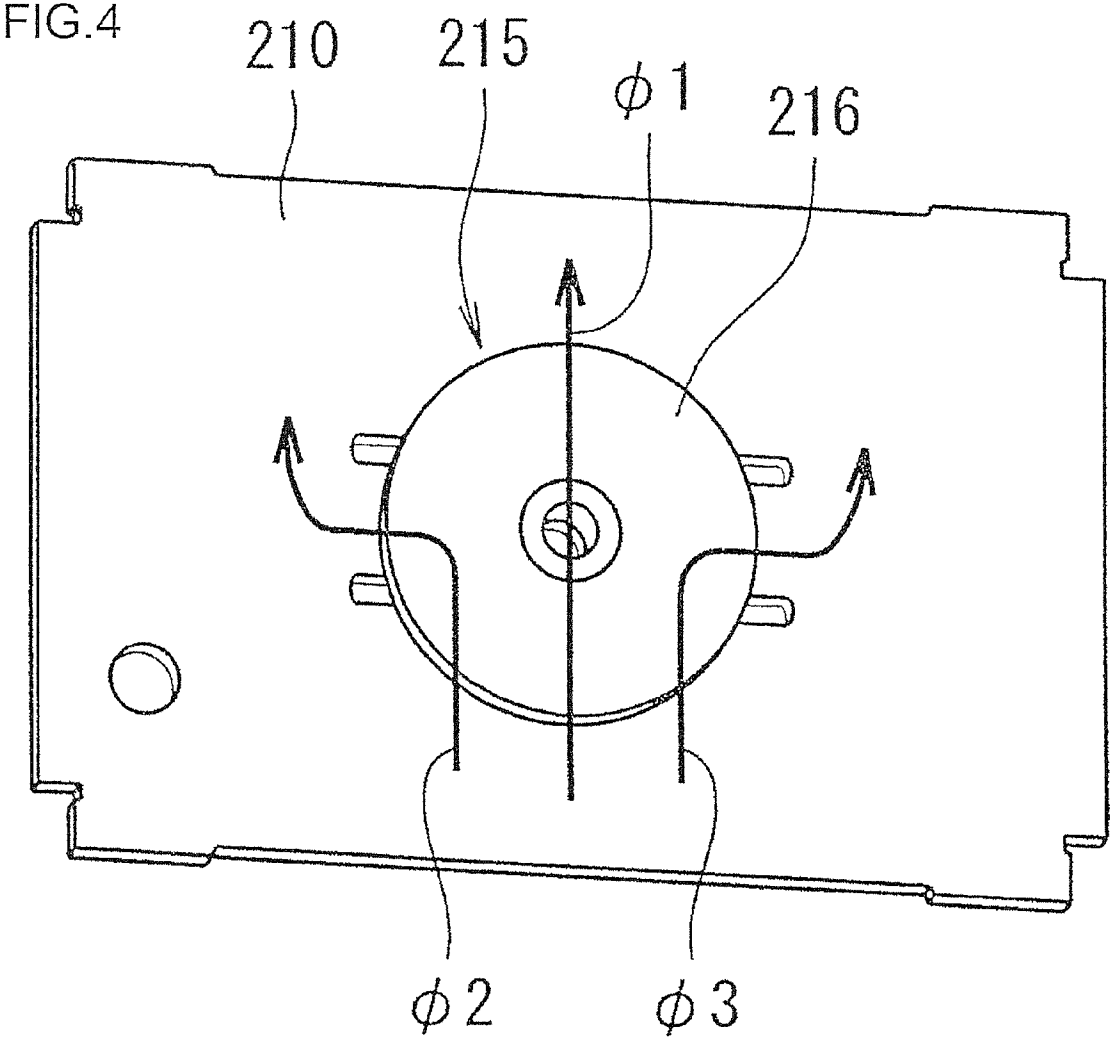
FIG. 4 is an illustration for illustrating a flow of magnetic fluxes generated by a flowing current.

At this time, magnetic fluxes heading from the front end side toward the rear end side of the upper magnetic yoke 210 are generated by a flowing current flowing through the main circuit, as shown in FIG. 4.

In this case, as the movable plunger 215 is inserted in the through hole 210*a* of the upper magnetic yoke 210, a magnetic flux 41 passing through the center of the movable plunger 215 passes directly through the movable plunger 215 and reaches the opposite upper magnetic yoke 210. However, left and right magnetic fluxes $\phi 2$ and $\phi 3$ outside the central portion, after having entered the movable plunger 215 once, enters the upper magnetic yoke 210 through respective magnetic paths overlapping the magnetic paths, formed by the exciting coil 208, which are sandwiched by the slit portions 210*c* and 210*d*, and head from the left and right outer sides of the slit portions 210*c* and 210*d* toward the rear end side of the upper magnetic yoke 210.

Because of this, the magnetic flux density between the contact pole surface 210*b* of the upper magnetic yoke 210 and the contact pole surface of the peripheral flange portion 216 of the movable plunger 215 which are kept in contact with each other by the magnetic force of the exciting coil 208, increases, thus increasing the holding force between the two contact pole surfaces. Consequently, it is possible to generate the holding force by positively utilizing the magnetic fluxes generated by the flowing current.

Figure 5:
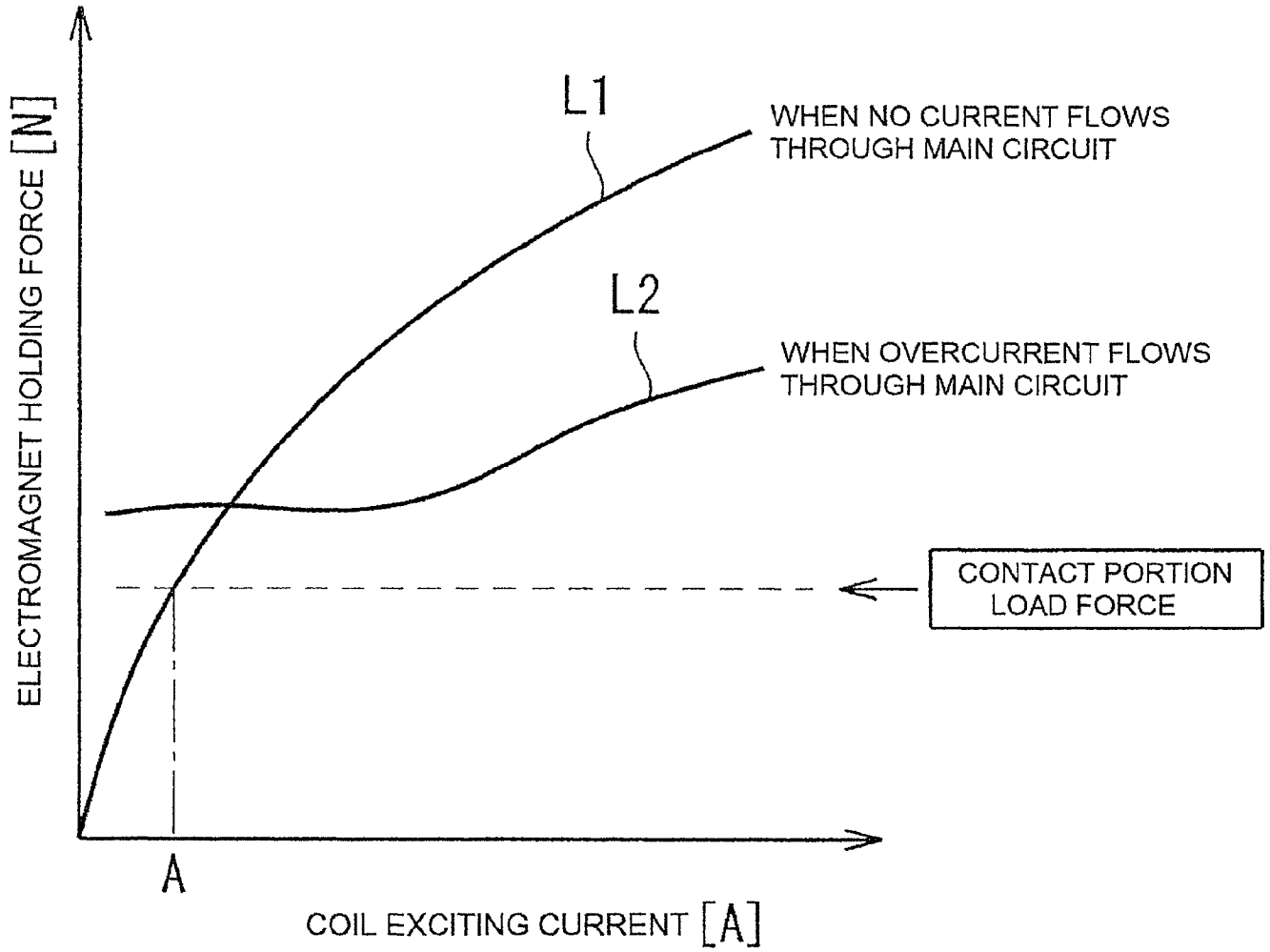
FIG. 5 is a characteristic diagram showing a relationship between a coil exciting current and an electromagnet holding force according to the invention.

An electromagnet holding force when an overcurrent flows through the main circuit is set so as to always exceed a contact portion load force when a coil exciting current, at which the electromagnet unit 200 is released, is at an A point on a characteristic line L1 showing when no current flows through the main circuit, as shown by a characteristic line L2 in FIG. 5.

Thereby, it is possible to reliably prevent the holding force from decreasing due to the magnetic fluxes of the exciting coil 208 being affected by the magnetic fluxes generated by the flowing current. As a result of this, it is possible to reliably maintain the state in which the peripheral flange portion 216 of the movable plunger 215 is attracted by the upper magnetic yoke 210, and thus possible to secure a stable operation of the electromagnetic contactor 10.

Figure 6:
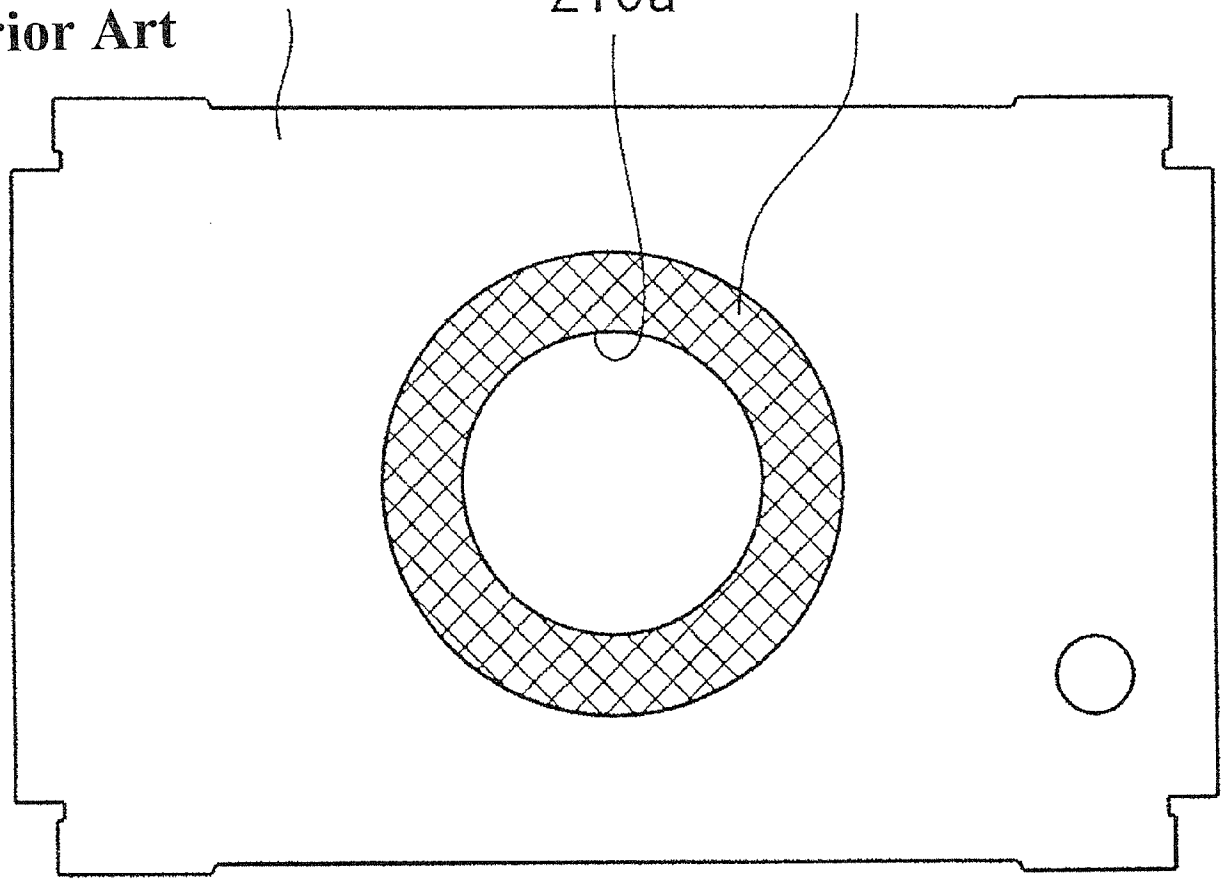
FIG.6 Prior Art
FIG. 6 is a plan view showing a heretofore known upper magnetic yoke.

Incidentally, a description will be given of a case in which the slits 210*e* formed of the slit portions 210*c* and 210*d* are not provided in the upper magnetic yoke 210, as shown in FIG. 6.

Figure 7:
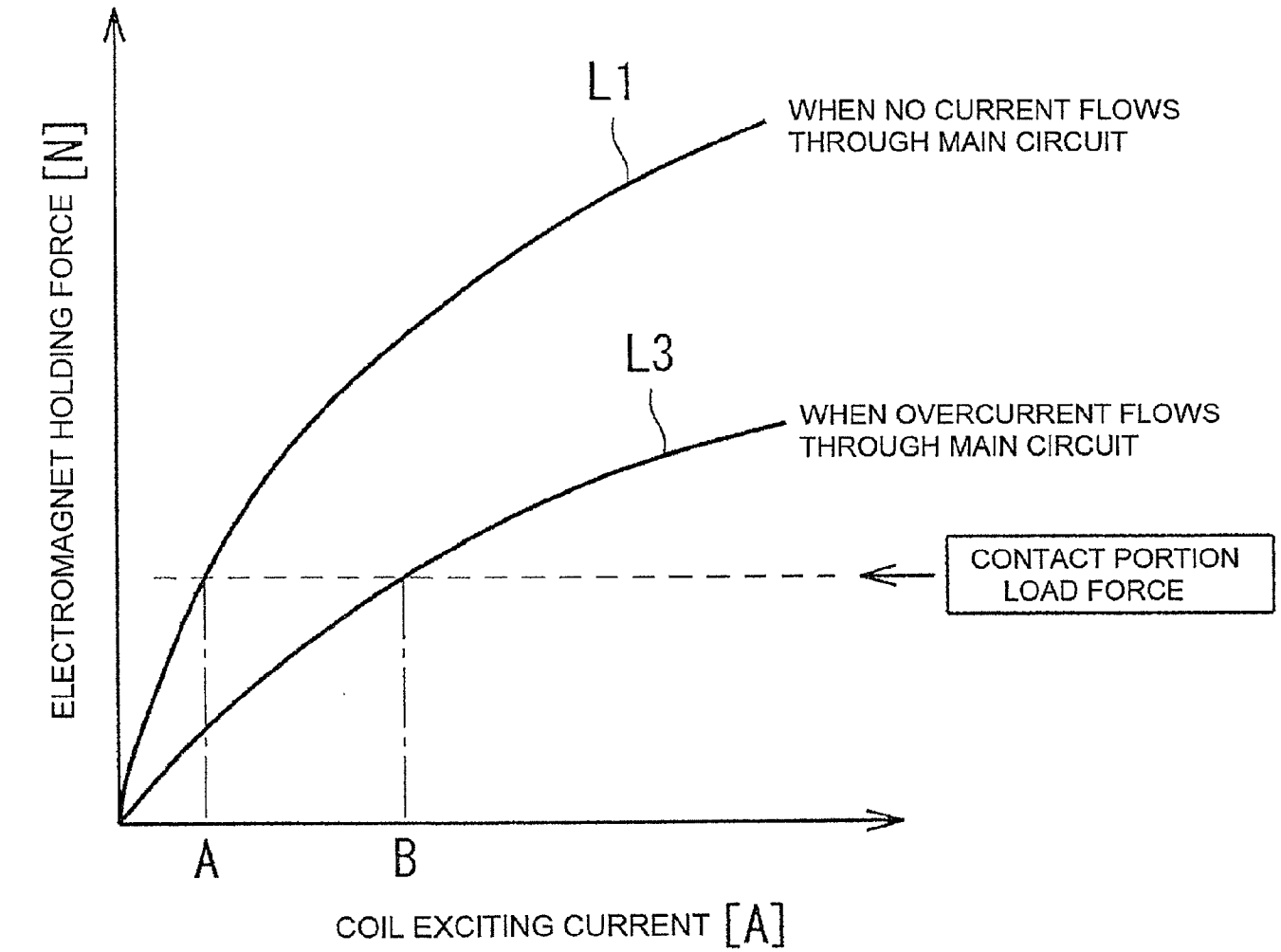
FIG.7 Prior Art
FIG. 7 is a characteristic diagram showing a relationship between a coil exciting current and an electromagnet holding force in the heretofore known example of FIG. 6.

In this case, as shown in FIG. 7, when a coil exciting current at which the electromagnet unit 200, when no current flows through the main circuit, is released, is at an A point, all magnetic fluxes generated by the main circuit current intersect with the magnetic fluxes generated by the exciting coil 208, when an overcurrent flows through the main circuit, thus exhibiting the characteristics that the electromagnet holding force decreases (a characteristic line L3).

Because of this, the coil exciting current at which the electromagnet unit 200 is released moves significantly to a B point when an overcurrent flows. Also, as an external magnetic field formed by a current is, in general, proportional to the value of the current, the larger the overcurrent flowing through the main circuit becomes, the farther the B point shifts to the right, and at the point which the value of the overcurrent exceeds a coil exciting current whose value is fixed by the specifications, the electromagnet unit 200 is no longer able to maintain the holding condition and is released.

In the embodiment, however, the magnetic paths are formed such that the magnetic fluxes generated by the main circuit current are added to the magnetic fluxes generated by the electromagnet unit 200, as heretofore described. Because of this, it is possible to maintain the state in which the peripheral flange portion 216 of the movable plunger 215 is attracted by the upper magnetic yoke 210 without any decrease in the magnet holding force when a current flows through the main circuit.

Also, when a current flows through the main circuit, an electromagnetic repulsive force in a direction which the movable contact 130 is opened is generated between the fixed contacts 111 and 112 and the movable contact 130.

However, each of the fixed contacts 111 and 112 includes the C-shaped contact conductor portion 115 formed of the upper plate portion 116, intermediate plate portion 117, and lower plate portion 118, as shown in FIG. 1. Because of this, the direction of a current flowing through the upper plate portion 116 is opposite to the direction of a current flowing through the lower plate portion 118 and movable contact 130. Consequently, a Lorentz force which presses the movable contact 130 against the fixed contact portions 118*a* of the fixed contacts 111 and 112 can be generated by Fleming's left-hand rule from the relationship between magnetic fields formed by the upper plate portions 116 of the fixed contacts 111 and 112 and the current flowing through the movable contact 130.

The Lorentz force can resist an electromagnetic repulsive force in a contact opening direction generated between the fixed contact portions 118*a* of the fixed contacts 111 and 112 and the movable contact portions 130*a* of the movable contact 130. Because of this, it is possible to reliably prevent the movable contact portions 130*a* of the movable contact 130 from opening. Consequently, it is possible to reduce the pressing force of the contact spring 134 supporting the movable contact 130, and thus possible to reduce the size of the contact spring 134. As a result, it is possible to reduce the size of the whole of the contact device 100.

The excitation of the exciting coil 208 of the electromagnet unit 200 is stopped when interrupting the supply of current to the load in a closed contact condition of the contact mechanism 101.

Thereby, in the electromagnet unit 200, there is no more exciting force to move the movable plunger 215 downward. Because of this, the movable plunger 215 ascends with the biasing force of the return spring 214, and the attractive force of the circular permanent magnet 220 increases as the peripheral flange portion 216 comes closer to the auxiliary yoke 225.

By ascending the movable plunger 215, the movable contact 130 linked to the movable plunger 215 via the linking shaft 131 ascends. In accordance with this, the movable contact 130 remains in contact with the fixed contacts 111 and 112 while a contact pressure is being given by the contact spring 134. Subsequently, an open contact condition in which the movable contact 130 is separated upward from the fixed contacts 111 and 112 is attained at the point which the contact pressure of the contact spring 134 is not given.

When the open contact condition is attained, arcs are generated between the fixed contact portions 118*a* of the fixed contacts 111 and 112 and the movable contact portions 130*a* of the movable contact 130, and a current flowing condition is continued by the arcs. At this time, as the insulating cover 121 is mounted to cover the upper plate portion 116 and intermediate plate portion 117 of the contact conductor portion 115 of each fixed contact 111 and 112, it is possible to generate arcs only between the fixed contact portions 118*a* of the fixed contacts 111 and 112 and the movable contact portions 130*a* of the movable contact 130.

Because of this, it is possible to reliably prevent arcs from moving on the contact conductor portions 115 of the fixed contacts 111 and 112 and stabilize an arc generation condition, and thus possible to improve arc extinguishing performance. Moreover, as the side surface of each fixed contact 111 and 112 is also covered with the insulating cover 121, it is also possible to reliably prevent the leading ends of the arcs from short-circuiting.

In this way, according to the heretofore described embodiment, the parallel slit portions 210*c* and 210*d* are formed so as to cross the contact pole surface 210*b* around the through hole 210*a* of the upper magnetic yoke 210, and magnetic paths through which magnetic fluxes generated by the main circuit current pass overlapping the magnetic paths formed by the exciting coil 208, are formed between the slit portions 210*c* and 210*d*. Because of this, it is possible to cause the magnetic fluxes of the main circuit current to act so as to enhance the electromagnet holding force, and thus possible to reliably maintain the condition in which the movable plunger 215 is held by the electromagnet unit 200. Consequently, it is possible to reliably stably operate the electromagnetic contactor 10.

Moreover, as a configuration for this purpose is provided with only the slit portions 210*c* and 210*d* in the upper magnetic yoke 210, it is possible to secure the state of holding the movable plunger 215 without adopting a complicated configuration.

Figure 8:
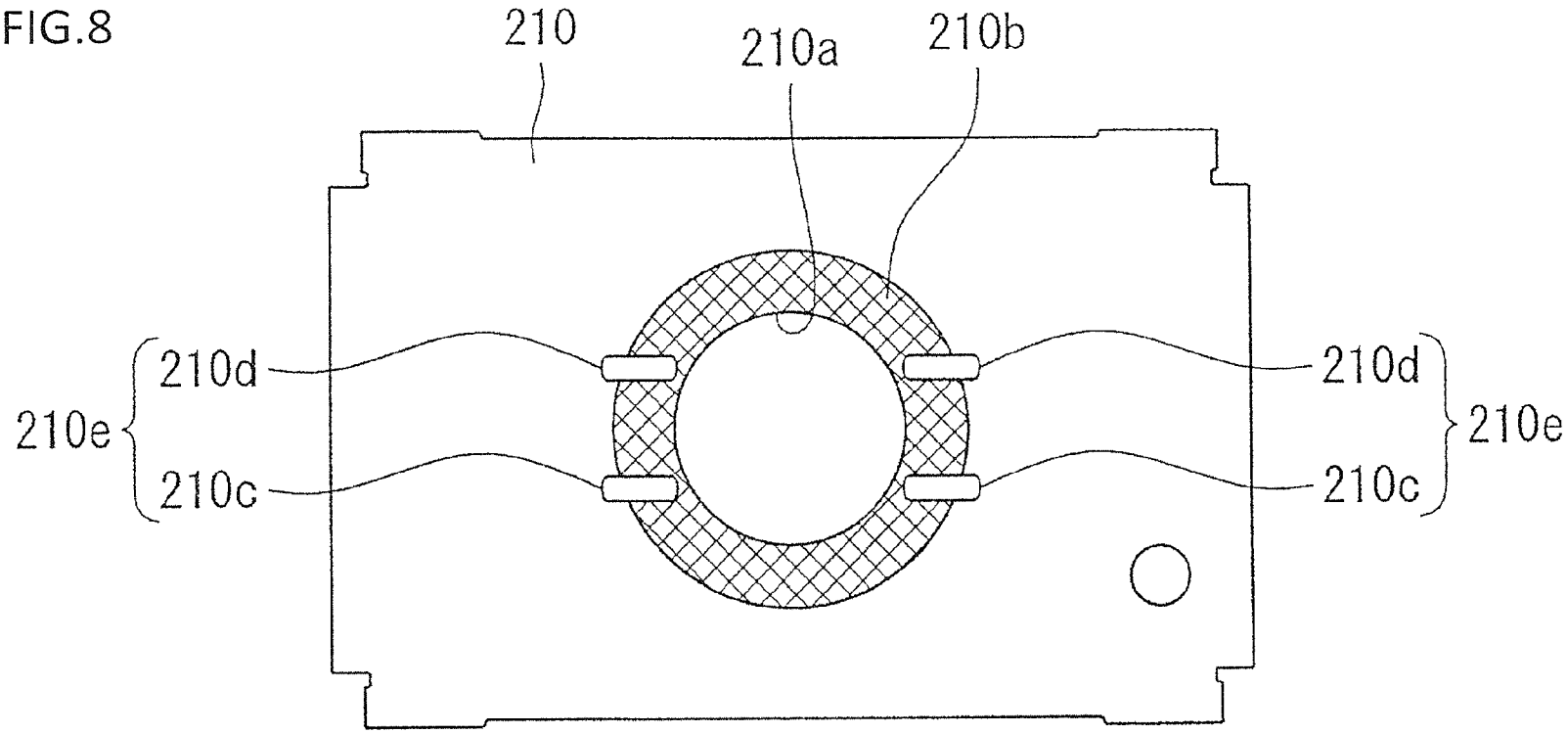
FIG. 8 is a plan view showing another example of the upper magnetic yoke of the invention.

In the heretofore described embodiment, a description has been given of a case in which the inward ends of the slit portions 210*c* and 210*d* formed in the upper magnetic yoke 210 open into the through hole 210*a*. However, the invention not being limited to this, it is possible to obtain the same working effects as in the heretofore described embodiment even when the slit portions 210*c* and 210*d* are formed so as not to open into the through hole 210*a*, as shown in FIG. 8.

Figure 9:
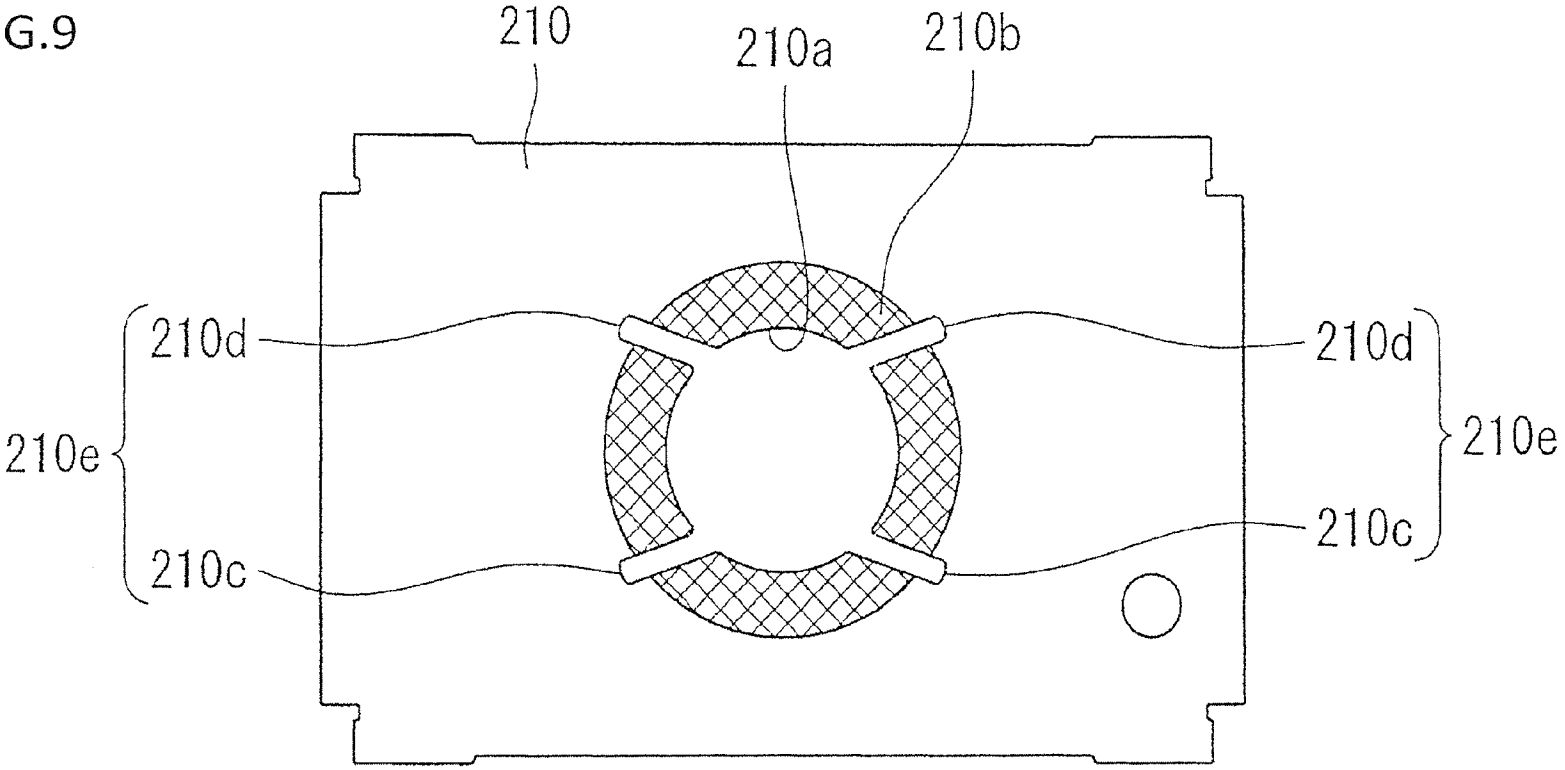
FIG. 9 is a plan view showing another example of the upper magnetic yoke of the invention.

Also, the slit portions 210*c* and 210*d*, not being limited to the case in which they are formed parallel to each other, may be formed in a state which they have a front-rear symmetry and open outward, as shown in FIG. 9. Furthermore, the slit portions 210*c* and 210*d* may be radially extended, as shown in FIG. 10.

Figure 11:
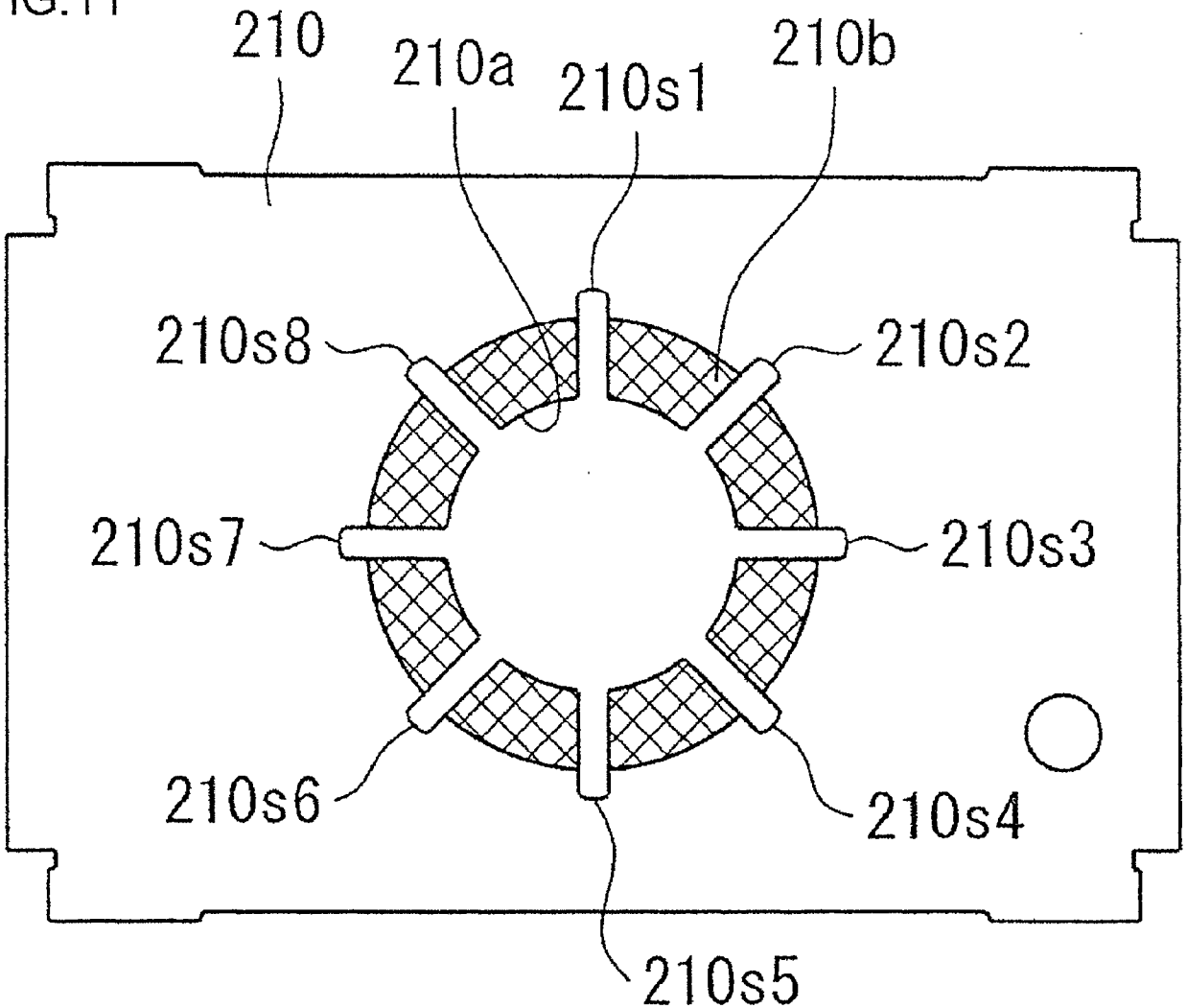
FIG. 11 is a plan view showing another example of the upper magnetic yoke of the invention.

Moreover, a configuration may include, for example, eight slit portions 210*s*1 to 210*s*8 extending in a radial direction thereof, as shown in FIG. 11, and magnetic paths, for example, through which the magnetic fluxes generated by the main circuit current between the slit portions 210*s*2 and 210*s*4 and between the slit portions 210*s*6 and 210*s*8 are passed, are formed. In this case, it is possible to optionally take any number equal to or larger than six as the number of slits.

Figure 12:
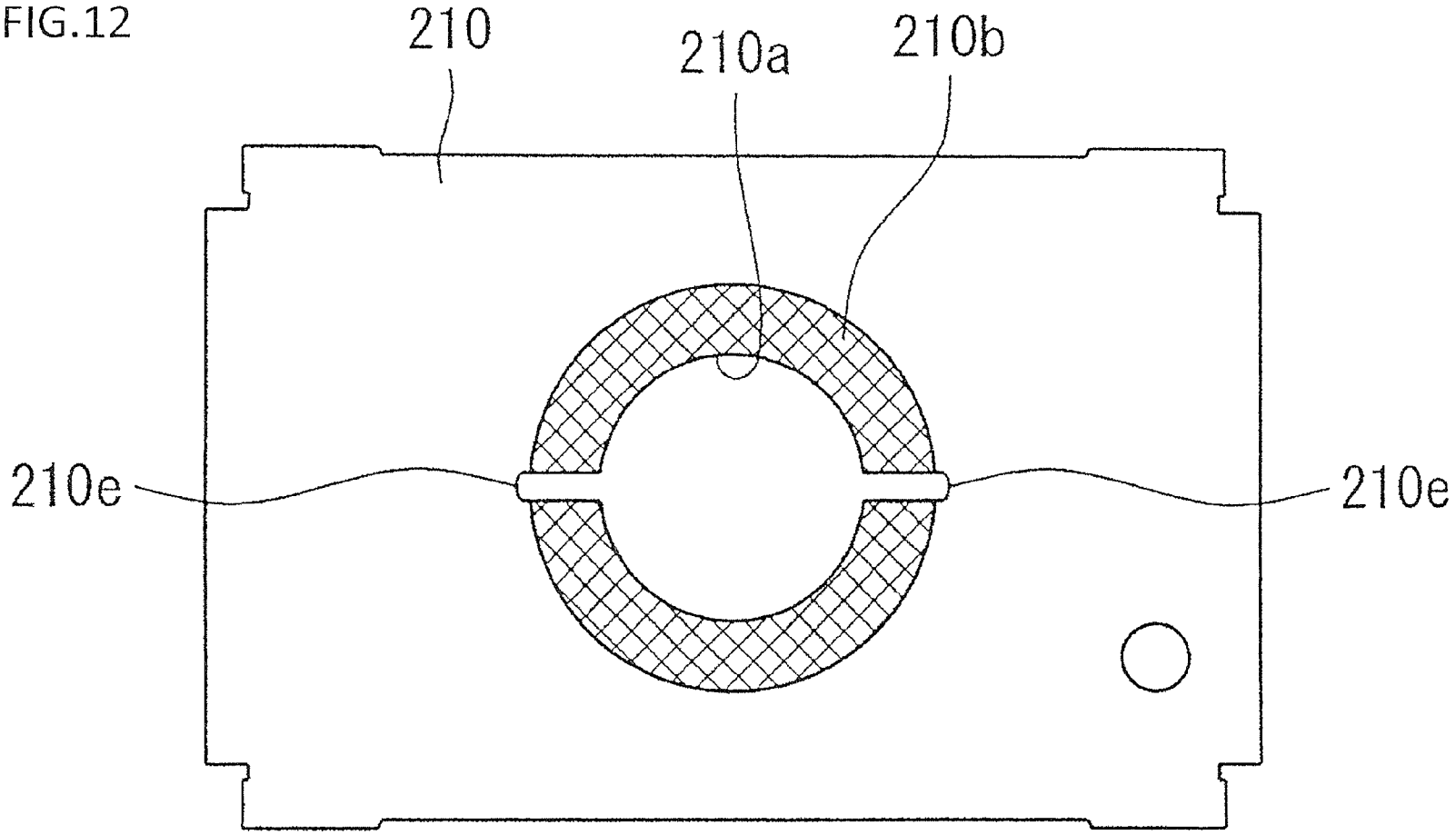
FIG. 12 is a plan view showing another example of the upper magnetic yoke of the invention.

Furthermore, although the efficiency of utilizing the magnetic fluxes generated by the main circuit current is down, one slit portion 210*e* may be formed on each of the left and right of the through hole 210*a*, as shown in FIG. 12.

Also, the through hole 210*a* of the upper magnetic yoke 210 and the movable plunger 215, not being limited to the case in which they are formed in a round shape in cross-section, can be formed in any cross-sectional shape such as a polygonal shape, such as a triangular shape or a quadrangular shape, or an elliptical shape. In accordance with this, only the inner cylindrical shape of the spool and the shape of the round cylindrical auxiliary yoke 203 may be changed.

Also, in the heretofore described embodiment, a description has been given of a case in which the contact housing case 102 is formed by brazing the metal quadrangular cylindrical body 104 and the fixed contact support insulating substrate 105 which closes the top of the metal quadrangular cylindrical body 104, but the invention is not limited to this. That is, the contact housing case 102 may be integrally formed in a tub-like shape from an insulating material such as a ceramic or synthetic resin material.

Figure 13A:
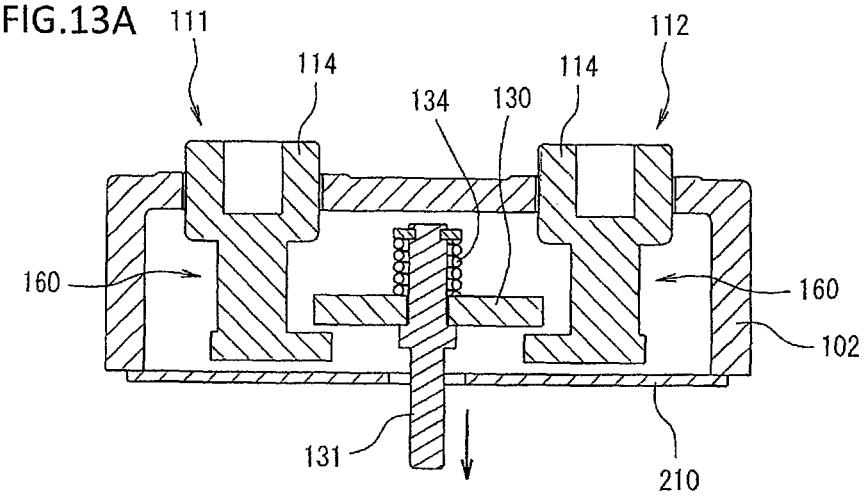
FIGS. 13(*a*) and 13(*b*) are diagrams, each showing a modification example of a contact device of the invention, wherein FIG. 13(*a*) is a sectional view, and FIG. 13(*b*) is a perspective view.
Figure 13B:
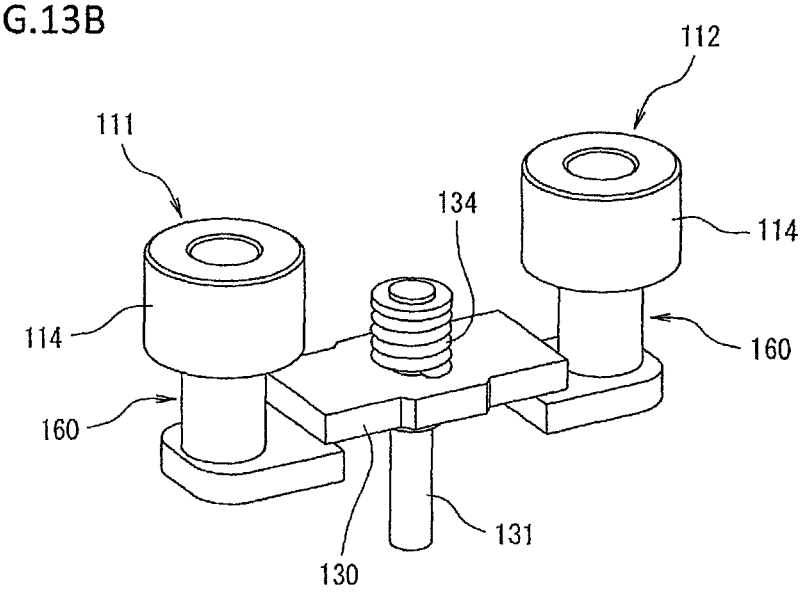

Also, in the heretofore described embodiment, a description has been given of a case in which the contact conductor portion 115 is formed in each fixed contact 111 and 112, but the invention is not limited to this, and an L-shaped portion 160 having a shape such that the upper plate portion 116 is omitted from the contact conductor portion 115, may be linked to each support conductor portion 114, as shown in FIGS. 13(*a*) and 13(*b*).

In this case, in the closed contact condition in which the movable contact 130 is brought into contact with the fixed contacts 111 and 112, magnetic fluxes generated by a current flowing through the vertical plate portions of the L-shaped portions 160 can act on the contact portions of the fixed contacts 111 and 112 and movable contact 130. Because of this, it is possible to generate a Lorentz force which resists the electromagnetic repulsive force by enhancing the magnetic flux density in the contact portions of the fixed contacts 111 and 112 and movable contact 130.

Figure 14A:
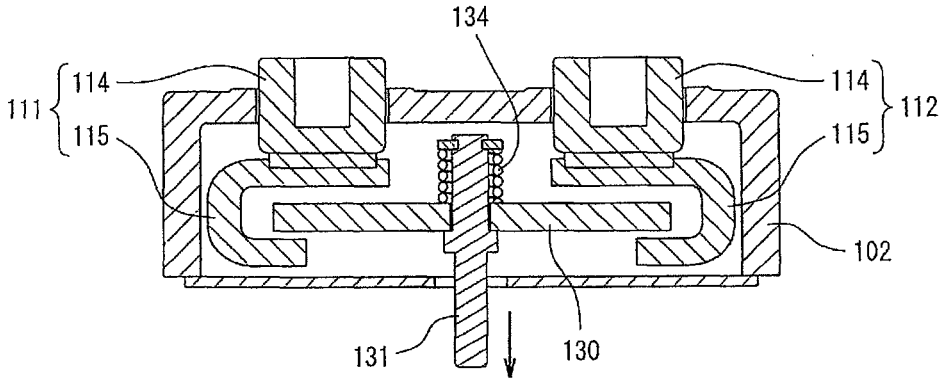
FIGS. 14(*a*) and 14(*b*) are diagrams, each showing another modification example of the contact device of the invention, wherein FIG. 14(*a*) is a sectional view, and FIG. 14 (*b*) is a perspective view.
Figure 14B:
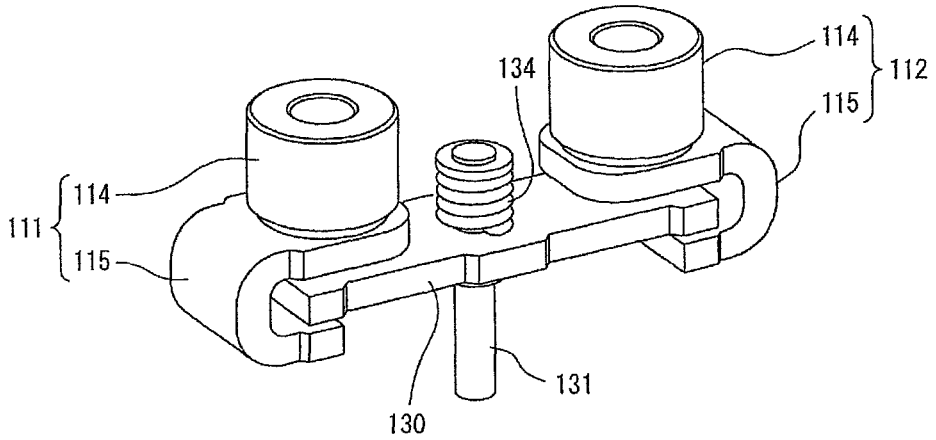

Also, in the heretofore described embodiment, a description has been given of a case in which the movable contact 130 has in the central portion thereof the depressed portion 132, but the invention is not limited to this, and the movable contact 130 may be formed in a flat plate-like shape by omitting the depressed portion 132, as shown in FIGS. 14(*a*) and 14(*b*).

Also, in the heretofore described embodiment, a description has been given of a case in which the linking shaft 131 is screwed in the movable plunger 215, but the movable plunger 215 and the linking shaft 131 may be integrally formed.

Also, a description has been given of a case in which the linking of the linking shaft 131 and movable contact 130 is provided such that the flange portion 131*a* is formed at the leading end portion of the linking shaft 131, and after the linking shaft 131 is inserted into the contact spring 134 and movable contact 130, the lower end of the movable contact 130 is fixed by the C-ring, but the invention is not limited to this. That is, a configuration may include a positioning large diameter portion protruding radially and formed in a C-ring position on the linking shaft 131, the contact spring 134 disposed after the movable contact 130 is brought into abutment with the positioning large diameter portion, and the upper end of the contact spring 134 fixed by the C-ring.

Figure 15:
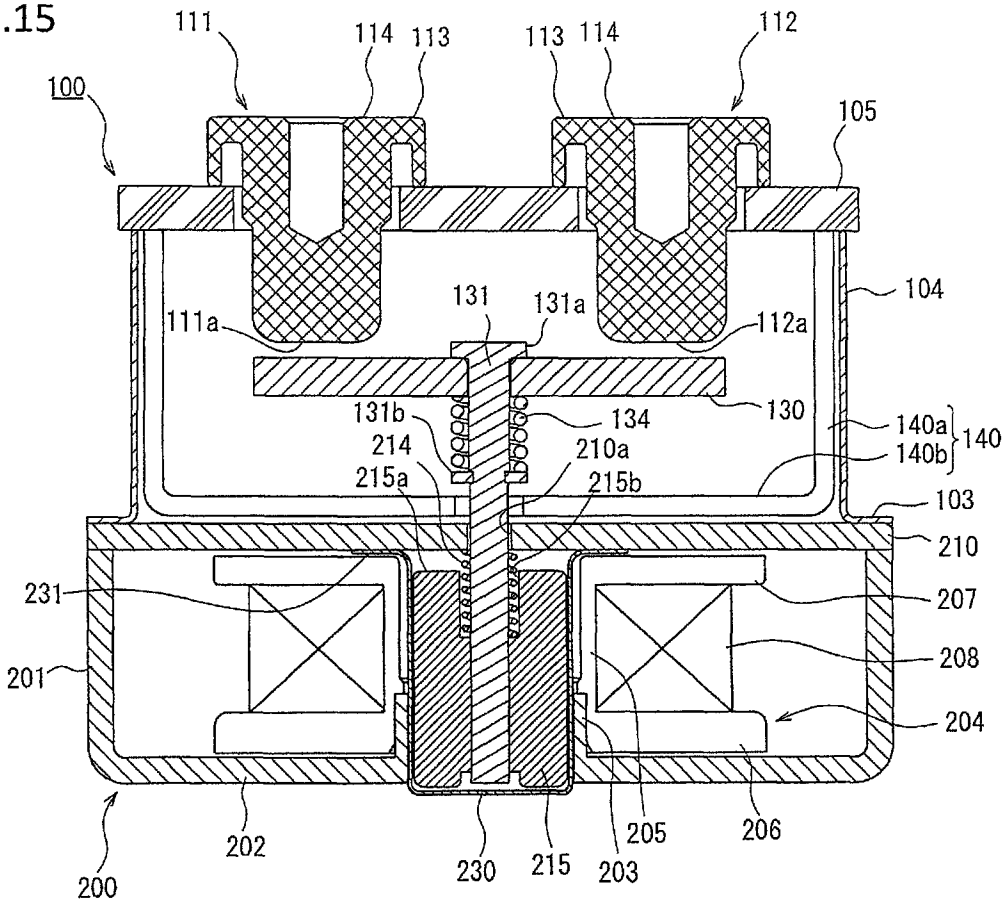
FIG. 15 is a sectional view showing a modification example of the electromagnetic switch according to the invention.

Also, in the heretofore described embodiment, a description has been given of a case in which the peripheral flange portion 216 of the movable plunger 215 advances from the upper side toward the upper magnetic yoke 210 and withdraws from the upper magnetic yoke 210 to the upper side, but the invention is not limited to this. That is, as shown in FIG. 15, the contact conductor portions 115 are omitted from the respective fixed contacts 111 and 112, and in place of the contact conductor portions 115, the support conductor portions 114 are extended downward to form fixed contact portions 111*a* and 112*a* on the lower surfaces of the extended support conductor portions 114.

Further, the movable contact 130 is disposed so as to face the fixed contacts 111 and 112 from the lower side. The through hole 133 is formed in the central portion in the left-right direction of the movable contact 130, and the linking shaft 131 linked to the movable plunger 215 of the electromagnet unit 200 is inserted in the through hole 133.

The linking shaft 131 has the flange portion 131*a* formed at the upper end thereof and protruding outward, and the movable contact 130 is disposed so as to be in contact with the flange portion 131*a*. Further, the contact spring 134 is inserted between the lower surface of the movable contact 130 on the linking shaft 131 and a C-ring 131*b* fixed therebelow.

The movable plunger 215 is formed in a round cylindrical shape with the peripheral flange portion 216 omitted in the previously described configuration of FIG. 1, and the upper end surface of the movable plunger 215 is formed as the contact pole surface 215*a* which comes into contact with the upper magnetic yoke 210 from the lower side.

Further, the return spring 214 disposed around the linking shaft 131 is disposed in a shouldered portion 215*b* formed on the inner peripheral side of an upper portion of the movable plunger 215, and the upper end of the return spring 214 is brought into abutment with the lower surface of the upper magnetic yoke 210. Consequently, the movable plunger 215 is pressed downward by the return spring 214.

Also, the slits 210*e* formed of the slits 210*c* and 210*d* shown in FIGS. 2 to 4 are formed in left and right symmetrical positions in the upper magnetic yoke 210 in the same way as in the previously described embodiment.

Furthermore, as the configuration of FIG. 15 has the same configuration as in the previously described FIG. 1 except that the permanent magnet 220 and auxiliary yoke 225 on the upper surface of the upper magnet yoke 210 are omitted, the same signs are given to portions corresponding to those in FIG. 1, and a detailed description thereof is omitted.

According to the configuration of FIG. 15, when the exciting coil 208 is in a non-excited state, the movable plunger 215 is pressed downward by the elastic force of the return spring 214, and the bottom surface of the movable plunger 215 is in abutment with the bottom surface of the cap 230 as shown in FIG. 15. In this state, the movable contact 130, being separated downward from the contact portions 111*a* and 112*a* of the fixed contacts 111 and 112, is in a non-conducting state with the fixed contacts 111 and 112.

By energizing the exciting coil 208 into an excited state in this state, magnetic paths are formed such that magnetic fluxes generated by the exciting coil 208 pass through the movable plunger 215, the contact pole surface 215*a* on the upper surface of the movable plunger 215, and the contact pole surface 210*b* of the upper magnetic yoke 210, from both left and right end portions of the upper magnetic yoke 210 through the magnetic yoke 202, and through the round cylindrical auxiliary yoke 203, and return to the lower surface side of the movable plunger 215.

Because of this, the movable plunger 215 is attracted to the upper magnetic yoke 210 against the return spring 214 and moves upward, and the movable contact 130 comes into contact with the fixed contact portions 118*a* of the fixed contacts 111 and 112 with the contact pressure of the contact spring 134.

Consequently, a closed contact condition is attained in which the large current of the external power supply source is supplied to the load through the main circuit formed of the fixed contact 111, movable contact 130, and fixed contact 112.

At this time, magnetic fluxes heading from the front end side to the rear end side of the upper magnetic yoke 210 are generated by a flowing current flowing through the main circuit, as shown in the previously described FIG. 4. In this case, as the upper surface of the movable plunger 215 is brought into contact with the through hole 210*a* of the upper magnetic yoke 210, the magnetic flux $\phi 1$ passing through the center of the movable plunger 215 passes directly through the movable plunger 215 and reaches the opposite upper magnetic yoke 210.

However, the left and right magnetic fluxes $\phi 2$ and $\phi 3$ outside the central portion, after having entered the movable plunger 215 once, enter the upper magnetic yoke 210 through magnetic paths overlapping the magnetic paths formed by the exciting coil 208 sandwiched between the slit portions 210*c* and 210*d*, and head from the left and right outer sides of the slit portions 210*c* and 210*d* toward the rear end side of the upper magnetic yoke 210.

Because of this, the magnetic flux density between the contact pole surface 210*b* of the upper magnetic yoke 210 and the contact pole surface 215*a* of the movable plunger 215, which are in contact with each other by the magnetic force of the exciting coil 208, increases, thus increasing the holding force therebetween.

Consequently, according to the heretofore described configuration, it is possible to generate the holding force by positively utilizing the magnetic fluxes generated by the energization current. Because of this, the electromagnet holding force when an overcurrent flows through the main circuit, can be set so as to always exceed the contact portion load force when a coil exciting current, at which the electromagnet unit 200 is released, is at the A point on the characteristic line L1 showing when no current flows through the main circuit, as shown by the characteristic line L2 in the previously described FIG. 5. Thereby, it is possible to reliably prevent a decrease of the holding force due to the magnetic fluxes of the exciting coil 208 affected by the magnetic fluxes generated by the flowing current. As a result of this, it is possible to reliably maintain the state in which the peripheral flange portion 216 of the movable plunger 215 is attracted by the upper magnetic yoke 210, and thus possible to secure a stable operation of the electromagnetic contactor 10.

With the configuration of FIG. 15, it is possible to select any one of the shapes in FIGS. 8 to 12 as the shape of the slits 210*e*.

Also, in the heretofore described embodiment, a description has been given of a case in which the hermetic container includes the contact housing case 102 and cap 230, and a gas is sealed in the hermetic container, but the invention is not limited to this, and the gas seal may be omitted when a current to be interrupted is low.

Furthermore, in the heretofore described embodiment, a description has been given of a case in which the invention is applied to an electromagnetic contactor, but the invention is not limited to this, and the invention can be applied to any switches including an electromagnetic relay and other electromagnetic switches.

REFERENCE SIGNS LIST

10 . . . Electromagnetic contactor, 100 . . . Contact device, 101 . . . Contact mechanism, 102 . . . Contact housing case (arc extinguishing chamber), 104 . . . Metal quadrangular cylindrical body, 105 . . . Fixed contact support insulating substrate, 111, 112 . . . Fixed contact, 111*a*, 112*a* . . . Fixed contact portion, 114 . . . Support conductor portion, 115 . . . Contact conductor portion, 116 . . . Upper plate portion, 117 . . . Intermediate plate portion, 118 . . . Lower plate portion, 118*a* . . . Fixed contact portion, 121 . . . Insulating cover, 130 . . . Movable contact, 131 . . . Linking shaft, 134 . . . Contact spring, 140 . . . Insulating cylindrical body, 200 . . . Electromagnet unit, 201 . . . Magnetic yoke, 203 . . . Round cylindrical auxiliary yoke, 204 . . . Spool, 208 . . . Exciting coil, 210 . . . Upper magnetic yoke, 210*a* . . . Through hole, 210*b* . . . Contact pole surface, 210*c*, 210*d* . . . Slit portion, 210*e* . . . Slit, 214 . . . Return spring, 215 . . . Movable plunger, 215*a* . . . Contact pole surface, 216 . . . Peripheral flange portion, 220 . . . Permanent magnet, 225 . . . Auxiliary yoke

What is claimed is:

1. An electromagnetic switch, comprising:

a pair of fixed contacts disposed and fixed in a contact housing case with a predetermined distance therebetween;

a movable contact disposed in the contact housing case so as to contact and separate from the pair of fixed contacts; and an electromagnet unit which brings the movable contact into and out of contact with the pair of fixed contacts, wherein the electromagnet unit has a magnetic yoke enclosing an exciting coil, a movable plunger having a contact pole surface facing a contact pole surface of the magnetic yoke, and a linking shaft which links the movable plunger and the movable contact, and a holding force for holding the movable plunger is generated and formed on the contact pole surface of the magnetic yoke by magnetic fluxes generated by a flowing current flowing through the movable contact when the movable contact contacts the pair of fixed contacts, and a magnetic path generated by the exciting coil and overlapped with the magnetic fluxes flowing through the movable contact.

2. An electromagnetic switch, comprising:

a pair of fixed contacts disposed and fixed in a contact housing case with a predetermined distance therebetween;

a movable contact disposed in the contact housing case so as to contact and separate from the pair of fixed contacts; and an electromagnet unit which brings the movable contact into and out of contact with the pair of fixed contacts, wherein the electromagnet unit has a magnetic yoke enclosing an exciting coil, a movable plunger, disposed so as to move through a through hole provided in the magnetic yoke and having a contact pole surface facing a contact pole surface of the magnetic yoke, and a linking shaft which links the movable plunger and the movable contact, and a holding force for holding the movable plunger is generated and formed on the contact pole surface of the magnetic yoke by magnetic fluxes generated by a flowing current flowing through the movable contact when the movable contact contacts the pair of fixed contacts, and a magnetic path generated by the exciting coil and overlapped with the magnetic fluxes flowing through the movable contact.

3. The electromagnetic switch according to claim 1, wherein the magnetic yoke includes a U-shaped magnetic yoke having an upper opening and surrounding the exciting coil, and an upper magnetic yoke which covers the upper opening of the U-shaped magnetic yoke and has a through hole passing vertically through the upper magnetic yoke; and the magnetic paths are formed on the contact pole surface of the upper magnetic yoke.

4. The electromagnetic switch according to claim 3, wherein the movable plunger has a peripheral flange portion facing the contact pole surface of the upper magnetic yoke from above, and a lower surface of the peripheral flange portion is formed as the contact pole surface.

5. An electromagnetic switch, comprising:

a pair of fixed contacts disposed and fixed in a contact housing case with a predetermined distance therebetween;

a movable contact disposed in the contact housing case so as to contact and separate from the pair of fixed contacts; and an electromagnet unit which brings the movable contact into and out of contact with the pair of fixed contacts, wherein the electromagnet unit has a magnetic yoke enclosing an exciting coil, a movable plunger having a contact pole surface facing a contact pole surface of the magnetic yoke, and a linking shaft which links the movable plunger and the movable contact, magnetic paths, through which a holding force is generated by magnetic fluxes generated by a flowing current when the movable contact contacts the pair of fixed contacts, are formed on the contact pole surface of the magnetic yoke, and the magnetic paths are formed of slits extending outwardly toward an outside of the movable contact from a through hole of the magnetic yoke.

6. The electromagnetic switch according to claim 5, wherein the slits include two pairs of slit portions extending parallel to each other from the through hole and formed in positions which sandwich the through hole and face the movable contact.

7. The electromagnetic switch according to claim 5, wherein the slits include two sets of a plurality slit portions extending radially from the through hole and formed in positions which sandwich the through hole and face the movable contact.

8. The electromagnetic switch according to claim 5, wherein the slits open into the through hole.

* * * * *